US012509899B2

(12) United States Patent
Ge

(10) Patent No.: US 12,509,899 B2
(45) Date of Patent: Dec. 30, 2025

(54) SWIMMING POOL CLEANING DEVICE OF UNDERWATER ROBOT

(71) Applicant: Taizhou Dibiao Technology Co., Ltd, Taizhou (CN)

(72) Inventor: Zhimin Ge, Taizhou (CN)

( * ) Notice: Subject to any disclaimer, the term of this patent is extended or adjusted under 35 U.S.C. 154(b) by 0 days.

(21) Appl. No.: 19/284,302

(22) Filed: Jul. 29, 2025

(65) Prior Publication Data

US 2025/0354400 A1 Nov. 20, 2025

(30) Foreign Application Priority Data

Jun. 25, 2025 (CN) ..... 202521321213.4

(51) Int. Cl.
*E04H 4/16* (2006.01)
*A47L 11/40* (2006.01)

(52) U.S. Cl.
CPC ..... *E04H 4/1654* (2013.01); *A47L 11/4072* (2013.01)

(58) Field of Classification Search
CPC ..... A47L 11/4072; E04H 4/16; E04H 4/1654
USPC ..... 15/1.7
See application file for complete search history.

(56) References Cited

U.S. PATENT DOCUMENTS 3,795,027 A * 3/1974 Lindberg, Jr. ..... A47L 9/0673 15/398
4,957,622 A * 9/1990 Mims ..... E02F 3/885 37/313
5,842,243 A * 12/1998 Horvath ..... E04H 4/1636 15/1.7
7,213,287 B2 * 5/2007 Hui ..... E04H 4/1654 210/167.16
7,975,339 B2 * 7/2011 Gavney, Jr. ..... A47L 13/11 15/117
10,294,686 B1 * 5/2019 Erlich ..... B63H 11/107
12,326,012 B2 * 6/2025 Wei ..... E04H 4/1654
2023/0110455 A1 * 4/2023 Wang ..... B25J 11/0085 15/1.7

FOREIGN PATENT DOCUMENTS

CN 222797172 U * 4/2024 ..... E04H 4/16
EP 4424950 A1 * 9/2024 ..... E04H 4/16

* cited by examiner

*Primary Examiner* — Laura C Guidotti
(74) *Attorney, Agent, or Firm* — Daniel M. Cohn; Howard M. Cohn

(57) ABSTRACT

The present disclosure belongs to the technical field of intelligent cleaning equipment, and in particular to a swimming pool cleaning device of an underwater robot. The present disclosure facilitates maintenance of the filter screen and the impellers through the detachable structure of the upper cover and the lower cover, and forms linkage with the inductor brackets and the through holes, and automatically separates the inductor brackets during disassembly and assembly, which simplifies assembly and ensures connection stability. The guide wheel system significantly improves the travel stability and obstacle crossing ability of the device on the bottom of the pool through the precise cooperation of the wheel grooves and the caster round shafts. The dual-motor drive cooperates with the concentrical drainage enclosures to form an efficient vortex, which ensures that the cleaning ability can still be maintained when a single motor fails, and greatly improves the efficiency of discharging fine impurities.

2 Claims, 8 Drawing Sheets

SWIMMING POOL CLEANING DEVICE OF UNDERWATER ROBOT

TECHNICAL FIELD

The present disclosure relates to the technical field of intelligent cleaning equipment, and in particular to a swimming pool cleaning device of an underwater robot.

BACKGROUND

Pool cleaning robots, also known as pool vacuum cleaners, underwater cleaners, water turtles, or fully automatic pool cleaners, come in various types, including manual vacuum cleaners, automatic vacuum cleaners, and remote-controlled vacuum cleaners. Manual vacuum cleaners require manual operation, whereas automatic and remote-controlled vacuum cleaners can operate autonomously or be controlled remotely, offering greater convenience and efficiency. In addition, fully automatic underwater cleaners have wall climbing functionality. When used in conjunction with a waterline cleaning program, these devices can clean along the edges of the pool, ensuring thorough coverage without leaving any uncleaned areas, such as pool walls or hard-to-reach spots, thereby guaranteeing the pool cleaning performance.

In the prior art, pool cleaning devices suffer from several technical deficiencies: the fixed structure of the water inlet component makes it difficult to clean clogged filter screens; the guide wheel system is prone to tracking deviations due to insufficient assembly precision; and the integrated design of upper and lower covers necessitates complete disassembly during maintenance, significantly compromising repair efficiency and leading to suboptimal use effect.

Therefore, a swimming pool cleaning device of an underwater robot is provided to solve the above problems.

SUMMARY OF THE APPLICATION

I. Technical Issues Solved

In view of the deficiencies in the prior art, the present disclosure provides a swimming pool cleaning device of an underwater robot, which solves the problems mentioned in the above background that the integrated design of the upper and lower covers is not conducive to maintenance, the guide wheels are prone to deviation, and the filter screens are difficult to clean.

II. Technical Solutions

In order to achieve the above objectives, the present disclosure specifically adopts the following technical solutions:

A swimming pool cleaning device of an underwater robot, comprising a cleaning device body, wherein a water inlet component and a water outlet component are respectively disposed at a bottom and a top of the cleaning device body, a filter screen is disposed inside the cleaning device body and located between the water inlet component and the water outlet component, and a plurality of guide wheels are disposed on the bottom of the cleaning device body;

The water inlet component includes a water inlet disposed on the bottom of the cleaning device body and a soft rubber scraper located on one side of the water inlet.

In some embodiments, the cleaning device body includes an upper cover and a lower cover, the water inlet component is arranged on a bottom of the lower cover, the water outlet component is arranged on a top of the upper cover, a circle of the lower cover is hinged with a plurality of hand buckles, a circle of the upper cover is provided with clamping grooves which are the same as the count of the hand buckles and are clamped with the hand buckles in a one-to-one correspondence manner, and the upper cover and the lower cover are detachably connected through cooperation between the hand buckles and the clamping grooves.

In some embodiments, the water inlet component further includes a water inlet fixing member and a three-hole plug, the water inlet fixing member is arranged inside the lower cover and is located on two sides of the water inlet, the three-hole plug is hinged to a bottom of the lower cover and is located on one side of the water inlet, and the soft rubber scraper is detachably mounted on the three-hole plug.

In some embodiments, decorative covers are clamped on two sides of the upper cover, and metal handles are fixedly provided on the other two sides of the upper cover, a circle of the lower cover is provided with a plurality of wheel grooves for mounting the guide wheels, and a caster round shaft is provided on an inner top of the wheel groove.

In some embodiments, the guide wheel includes a guide wheel bracket and a guide wheel body rotatably arranged inside the guide wheel bracket through a latch, a connecting shaft is arranged at the top end of the guide wheel bracket, the top end of the connecting shaft passes through the caster shaft and extends to the inside of the lower cover and is provided with a retaining spring.

In some embodiments, four guide wheels and four wheel grooves are provided, respectively, at least two inductor brackets are arranged inside the upper cover, two guide wheel brackets are provided with through holes corresponding to the two inductor brackets, respectively, a bottom end of each inductor bracket penetrates through the through hole and extends into the guide wheel bracket, and an inductor circuit board is disposed inside the inductor bracket.

In some embodiments, an operation port is disposed at a middle position of the bottom of the lower cover, a fixed base opposite to the operation port is disposed inside the lower cover, a driving component is disposed inside the upper cover, the driving component includes a base and an upper shell disposed on a top of the base, and at least two motors are disposed inside the base.

In some embodiments, an indicator light bracket is disposed on a top of the upper shell, an indicator light circuit board is disposed inside the indicator light bracket, a top of a lamp bead on the indicator light circuit board penetrates through a top of the upper cover, a battery is disposed inside the base, a bottom of the base penetrates through the fixed base and extends into the operation port, and a charging port sealing plug and a waterproof switch button are disposed on the bottom of the base.

In some embodiments, the water outlet component includes a flow channel baffle disposed on a top of the upper cover and a drainage cover disposed on a top of the flow channel baffle, two impellers are rotatably disposed inside the flow channel baffle, and interiors of the two impellers are fixedly sleeved with output shafts of two motors, respectively.

In some embodiments, two drainage enclosures are disposed inside the drainage cover, tops of the two impellers extend into the drainage cover and are arranged concentrically with centers of the two drainage enclosures, respectively, drainage ports respectively connected to the two drainage enclosures are disposed on two sides of the drainage cover, and a water outlet flap is movably disposed inside each drainage port.

III. Beneficial Effects

Compared with the prior art, the present disclosure provides the swimming pool cleaning device of the underwater robot, which has the following beneficial effects:

The present disclosure facilitates maintenance of the filter screen and the impellers through the detachable structure of the upper cover and the lower cover, and forms linkage with the inductor brackets and the through holes, and automatically separates the inductor brackets during disassembly and assembly, which simplifies assembly and ensures connection stability. The guide wheel system significantly improves the travel stability and obstacle crossing ability of the device on the bottom of the pool through the precise cooperation of the wheel grooves and the caster round shafts. The dual-motor drive cooperates with the concentrical drainage enclosures to form an efficient vortex, which ensures that the cleaning ability can still be maintained when a single motor fails, and greatly improves the efficiency of discharging fine impurities. In terms of user-friendly design, the alignment and maintenance scheme of the operation port and the fixed base, the swingable and detachable soft rubber scraper, the waterproof switch and other details cooperate with each other. Under the premise of ensuring IPX8 waterproof performance, the equipment maintenance is more convenient and the service life is longer. The overall structure achieves comprehensive improvement in cleaning efficiency, operation reliability and maintenance convenience through the organic cooperation among various components.

Figure 1:
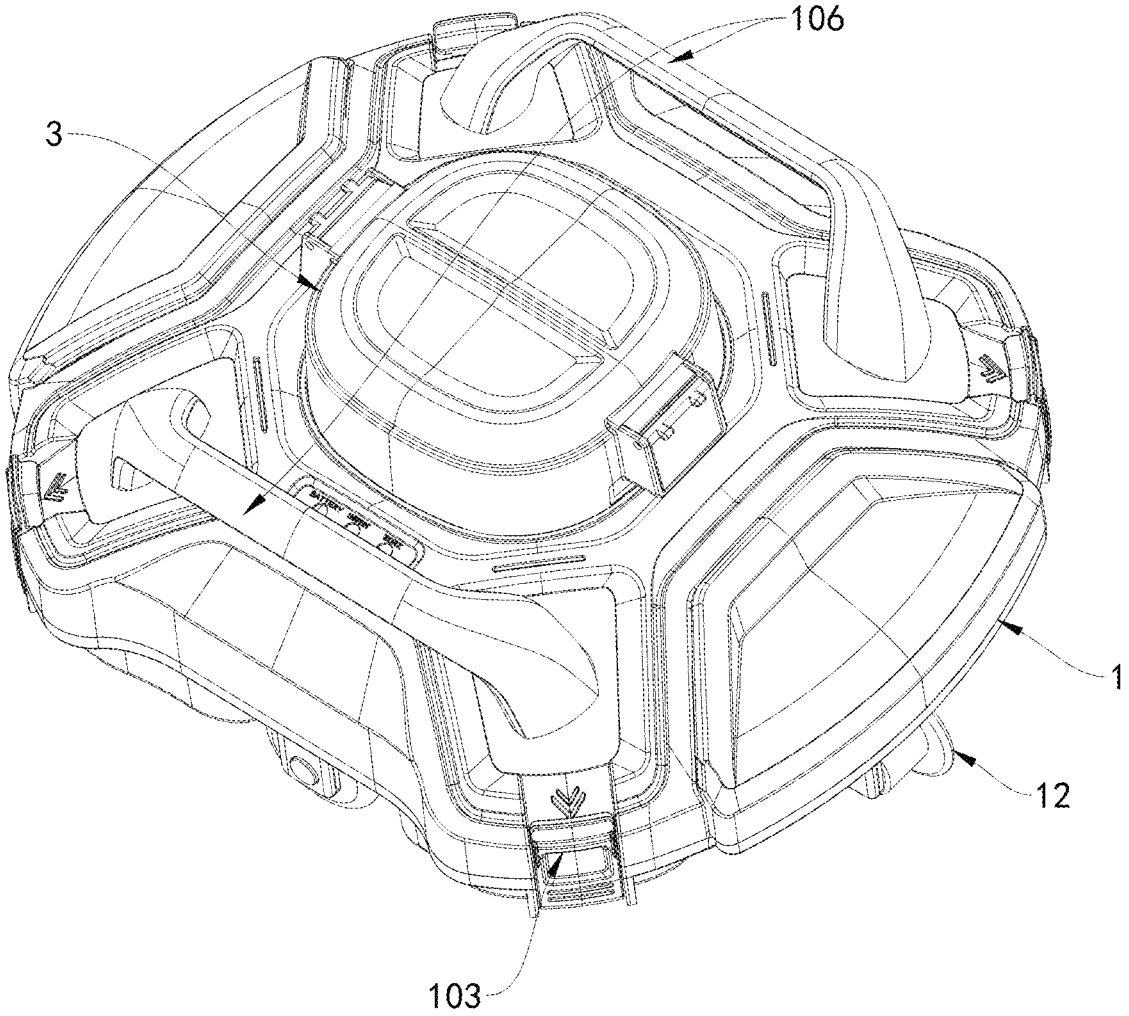
FIG. 1 is a schematic structural diagram of a cleaning device body according to the present disclosure.

Reference signs in the figures: 1. cleaning device body; 101. upper cover; 102. lower cover; 103. hand buckle; 104. clamping groove; 105. decorative cover; 106. metal handle; 107. inductor bracket; 108. operation port; 109. inductor circuit board; 11. filter screen; 12. guide wheel; 121. guide wheel bracket; 122. pin; 123. guide wheel body; 124. connecting shaft; 125. retaining ring; 126. through hole; 127. limiting plate; 13. wheel groove; 14. caster round shaft; 15. fixed base; 16. driving component; 161. base; 162. upper shell; 163. motor; 164. indicator light bracket; 165. indicator light circuit board; 166. lamp bead; 167. battery; 168. charging port sealing plug; 169. waterproof switch button; 2. water inlet component; 21. water inlet; 22. soft rubber scraper; 23. water inlet fixing member; 24. three-hole plug; 3. water outlet component; 31. flow channel baffle; 32. drainage cover; 33. impeller; 34. drainage enclosure; 35. drainage port; 36. water outlet flap.

DETAILED DESCRIPTION

The following will clearly and completely describe the technical solutions in the embodiments of the present disclosure with reference to the drawings in the embodiments of the present disclosure. Obviously, the described embodiments are only part of the embodiments of the present disclosure, not all of the embodiments. Based on the embodiments of the present disclosure, all other embodiments obtained by those having ordinary skills in the art without creative work are within the scope of protection of the present disclosure.

Embodiments

As shown in FIGS. 1-8, a swimming pool cleaning device of an underwater robot according to one embodiment of the present disclosure includes a cleaning device body 1. A water inlet component 2 and a water outlet component 3 are respectively disposed at a bottom and a top of the cleaning device body 1. A filter screen 11 is disposed inside the cleaning device body 1 and located between the water inlet component 2 and the water outlet component 3. A plurality of guide wheels 12 are disposed on the bottom of the cleaning device body 1;

The water inlet component 2 includes a water inlet 21 disposed on the bottom of the cleaning device body 1 and a soft rubber scraper 22 located on one side of the water inlet 21.

Figure 6:
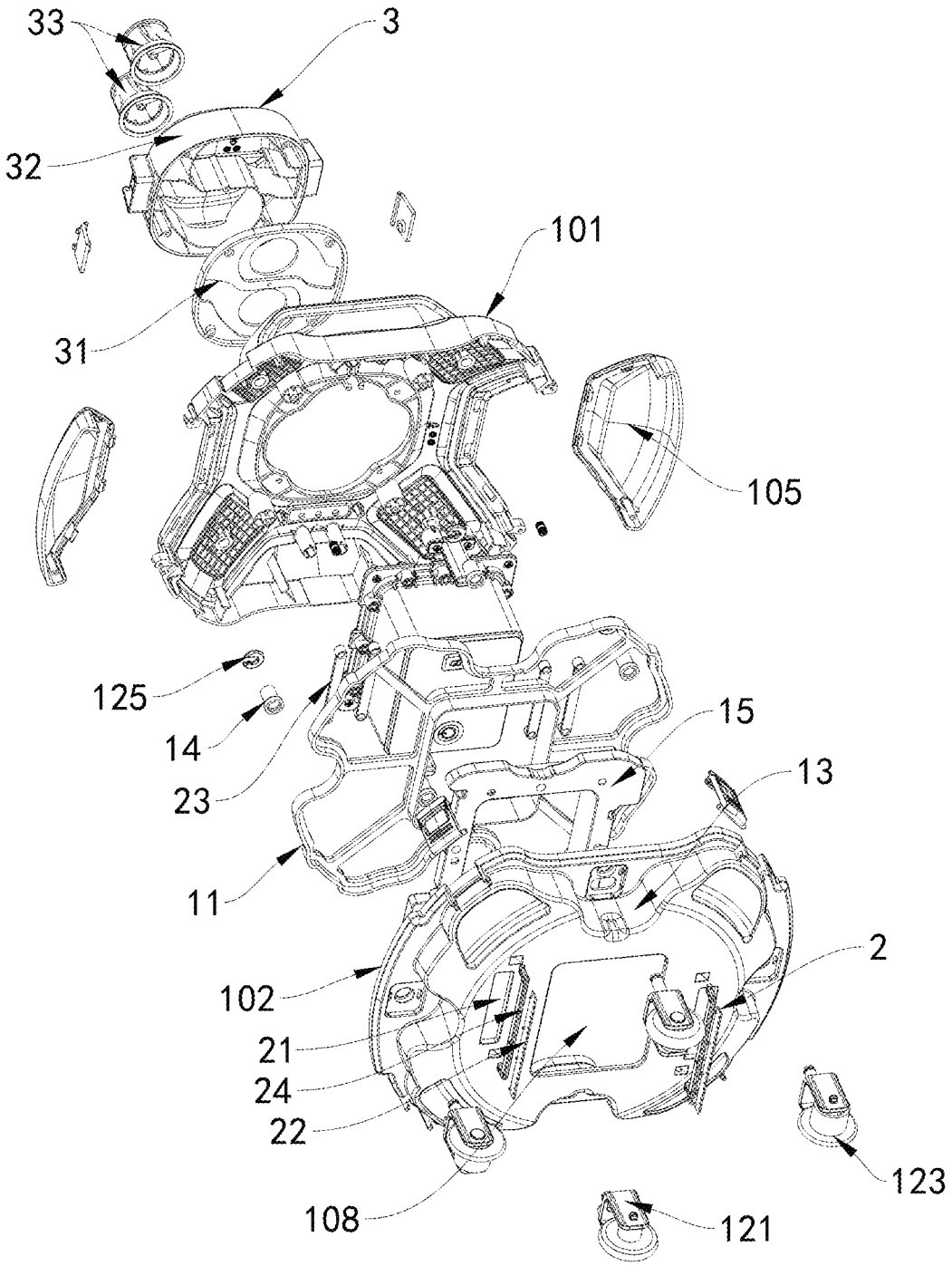
FIG. 6 is a schematic structural diagram of a fixed base according to the present disclosure.

As shown in FIG. 6, in some embodiments, the cleaning device body 1 includes an upper cover 101 and a lower cover 102. The water inlet component 2 is arranged on a bottom of the lower cover 102. The water outlet component 3 is arranged on a top of the upper cover 101. A circle of the lower cover 102 is hinged with a plurality of hand buckles 103. A circle of the upper cover 101 is provided with clamping grooves 104 which are the same as the count of the hand buckles 103 and are clamped with the hand buckles 103 in a one-to-one correspondence manner. The upper cover 101 and the lower cover 102 are detachably connected through cooperation between the hand buckles 103 and the clamping grooves 104.

The upper cover 101 and the lower cover 102 are connected through the hand buckles 103 and the clamping grooves 104 so that while the stable connection is guaranteed, it is convenient for disassembly and maintenance, and filter screens 11 can be cleaned and impellers 33 can be disassembled, which significantly improves the maintenance convenience of the filter screens 11 and reduces the overall maintenance difficulty of the device.

As shown in FIG. 6, in some embodiments, the water inlet component 2 further includes a water inlet fixing member 23 and a three-hole plug 24. The water inlet fixing member 23 is arranged inside the lower cover 102 and is located on two sides of the water inlet 21. The three-hole plug 24 is hinged to a bottom of the lower cover 102 and is located on one side of the water inlet 21. The soft rubber scraper 22 is detachably mounted on the three-hole plug 24.

The hinged connection between the three-hole plug 24 and the lower cover 102 allows the three-hole plug 24 to drive the soft rubber scraper 22 to swing slightly. The soft rubber scraper is clamped on the three-hole plug 24 through holes on the three-hole plug 24. The design of the detachable soft rubber scraper 22 extends the service life of the components and reduces the cost of replacing consumables.

Figure 5:
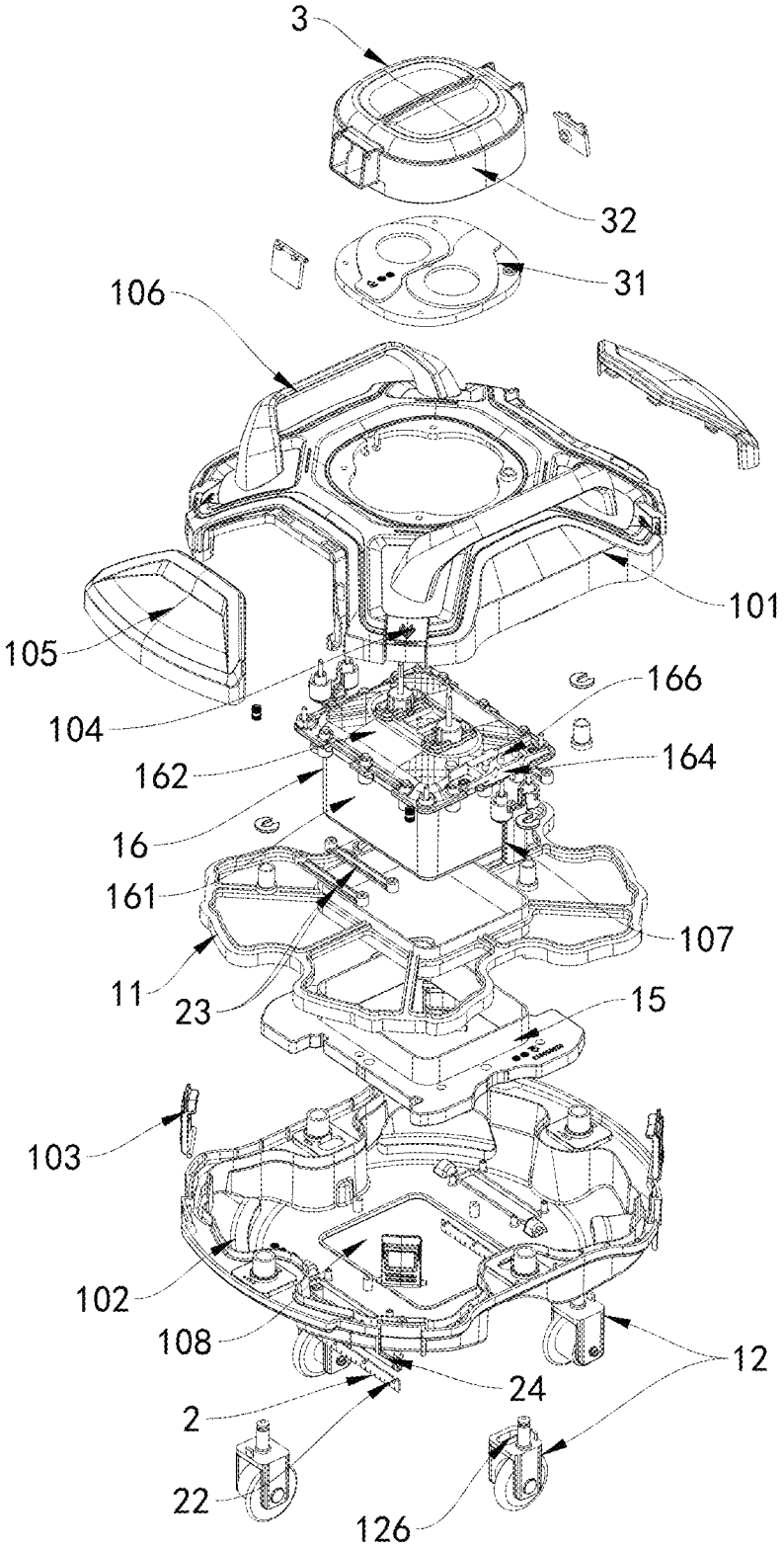
FIG. 5 is a schematic structural diagram of a decorative cover according to the present disclosure.

As shown in FIG. 5, in some embodiments, decorative covers 105 are clamped on two sides of the upper cover 101, and metal handles 106 are fixedly provided on the other two sides of the upper cover 101. A circle of the lower cover 102 is provided with a plurality of wheel grooves 13 for mounting the guide wheels 12, and a caster round shaft 14 is provided on an inner top of the wheel groove 13.

The cooperation structure of the wheel grooves 13 and the caster round shafts 14 enhances the travel stability and prevents rollover. The metal handles 106 are ergonomically designed to facilitate uniform force during transportation. The decorative covers 105 and the upper cover 101 can be processed in contrasting colors, and the decorative covers 105 can improve the appearance of the product.

Figure 4:
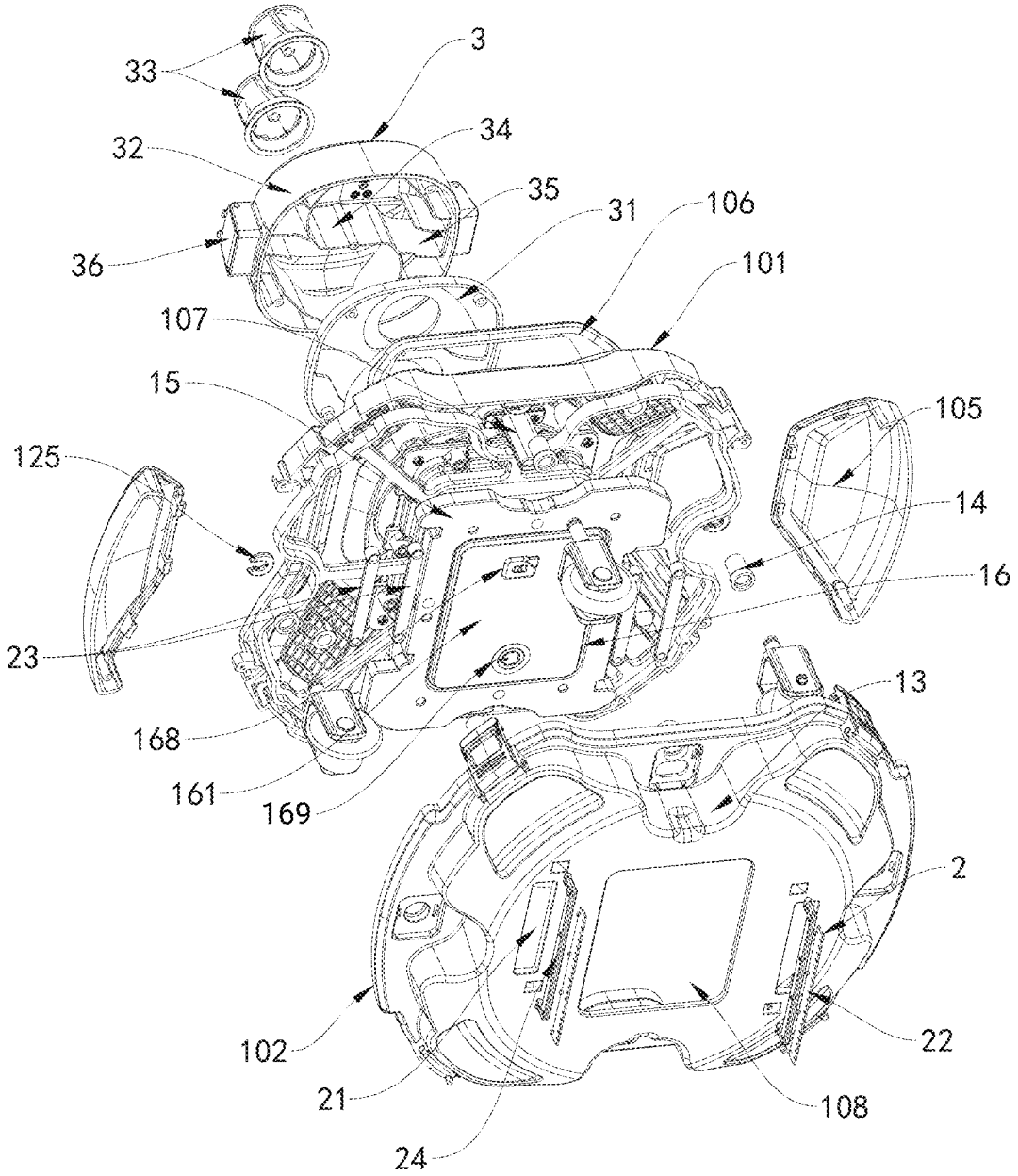
FIG. 4 is an exploded view of a water inlet component according to the present disclosure.

As show in FIG. 4, in some embodiments, the guide wheel 12 includes a guide wheel bracket 121 and a guide wheel body 123 rotatably arranged inside the guide wheel bracket 121 through a pin 122. A connecting shaft 124 is disposed at a top end of the guide wheel bracket 121. A top end of the connecting shaft 124 penetrates through the caster round shaft 14 to extend into the lower cover 102 and is provided with a retaining spring 125. A top of the guide wheel bracket 121 is provided with a limiting plate 127 of which a top end penetrates to an interior of the lower cover 102.

The design of the top end of the connecting shaft 124 penetrating through the caster round shaft 14 and the pin 122 type rotating structure reduces friction loss. The fixation of the retaining spring 125 prevents from falling off during underwater operation. The penetration design of the connecting shaft 124 enhances the axial bearing capacity and adapts to the uneven bottom of the pool. The design of the limiting plate 127 ensures the assembly stability of the guide wheel bracket 121 and prevents from deviation.

As shown in FIG. 4, in some embodiments, four guide wheels 12 and four wheel grooves 13 are provided, respectively. At least two inductor brackets 107 are arranged inside the upper cover 101. Two guide wheel brackets 121 are provided with through holes 126 corresponding to the two inductor brackets 107, respectively. A bottom end of each inductor bracket (107) penetrates through the through hole 126 and extends into the guide wheel bracket 121. An inductor circuit board 109 is disposed inside the inductor bracket 107.

The bottom end of the inductor bracket 107 penetrates through the through hole 126 and extends into the guide wheel bracket 121, and the through hole 126 cooperates with the inductor bracket 107 to achieve precise positioning. The four-wheel configuration enhances the obstacle crossing capability. When the upper cover 101 is separated from the lower cover 102, the upper cover 101 drives the inductor bracket 107 to separate from the interior of the through hole 126. The design of the inductor bracket 107 being sleeved inside the through hole 126 not only simplifies the assembly process and ensures the assembly stability of the inductor circuit board 109, but also further ensures the connection stability between the upper cover 101 and the lower cover 102.

As shown in FIG. 6, in some embodiments, an operation port 108 is disposed at a middle position of the bottom of the lower cover 102, a fixed base (15) opposite to the operation port 108 is disposed inside the lower cover 102, a driving component 16 is disposed inside the upper cover 101, the driving component 16 includes a base 161 and an upper shell 162 disposed on a top of the base 161, and at least two motors 163 are disposed inside the base 161.

The two motors 163 drive the two impellers 33, respectively. This design ensures that when a single motor 163 fails, the cleaning capacity can still be maintained at 50%. The alignment design of the fixed base 15 and the operation port 108 is convenient for maintenance without completely disassembling the device. When the upper cover 101 and the lower cover 102 are separated, the upper cover 101 drives the motor 163 component to be pulled out from the interior of the operation port 108 and the fixed base 15. The setting of the operation port 108 makes it convenient for users to control the motor 163 component.

Figure 2:
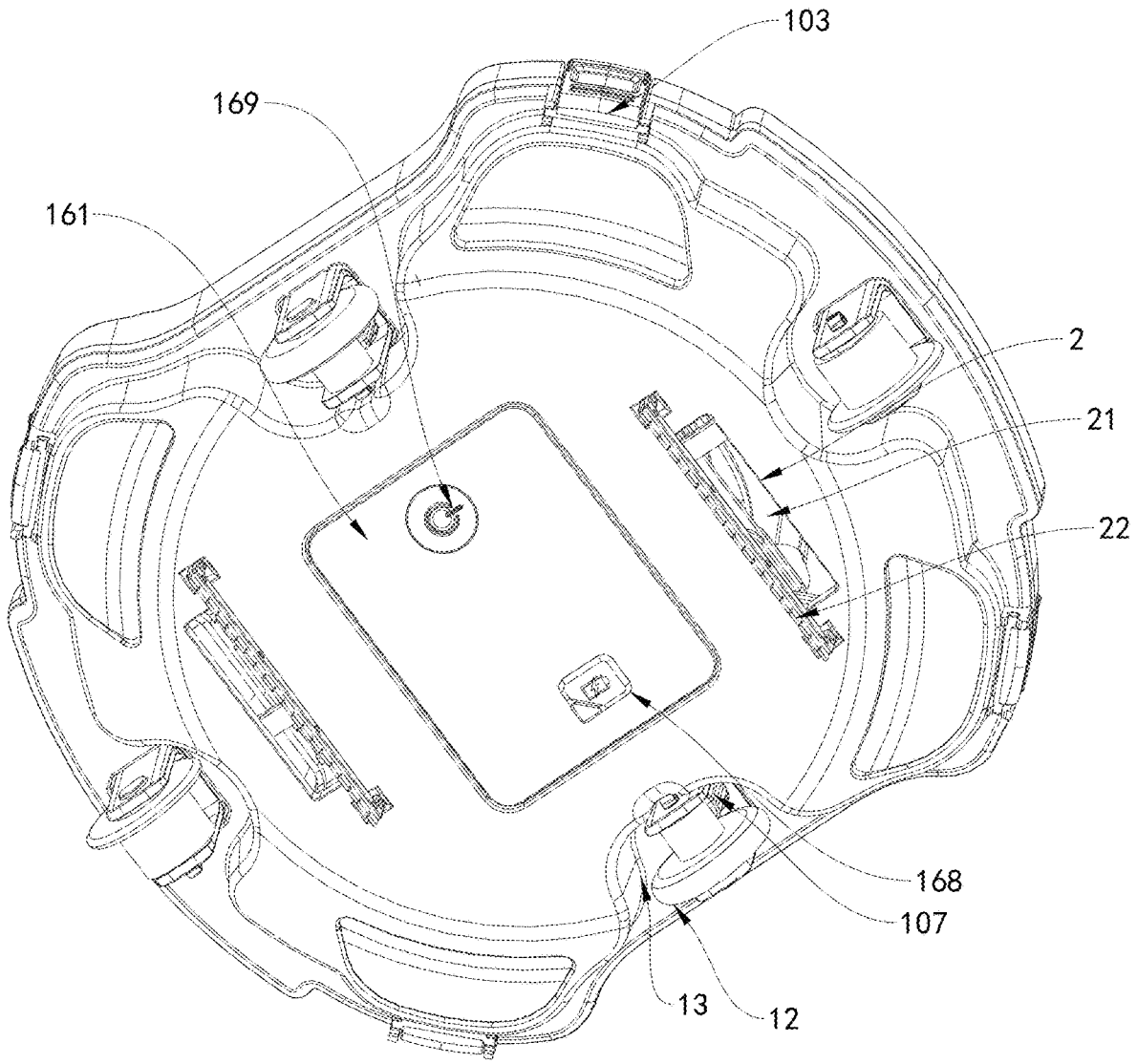
FIG. 2 is a schematic structural diagram of a bottom of a cleaning device body according to the present disclosure.
Figure 3:
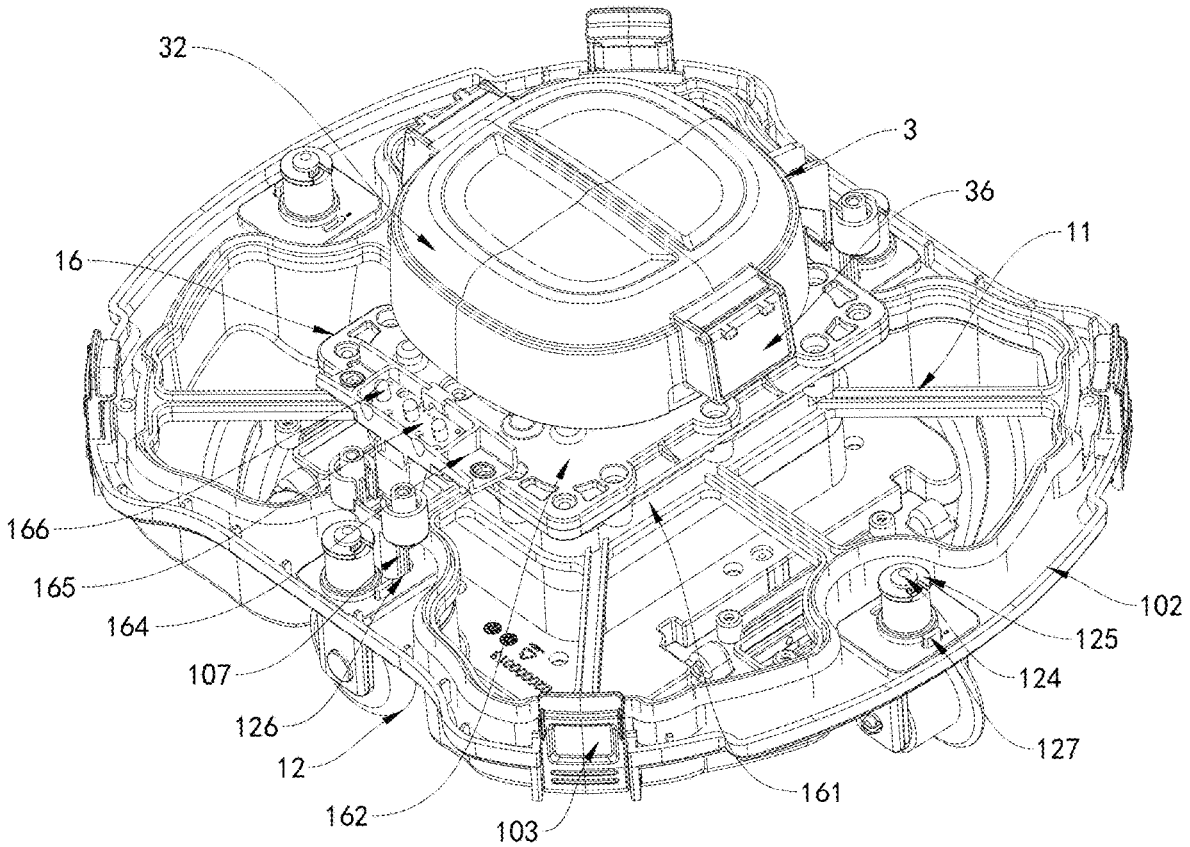
FIG. 3 is a schematic structural diagram of a lower cover according to the present disclosure.

As shown in FIGS. 1-3, in some embodiments, an indicator light bracket 164 is disposed on a top of the upper shell 162, an indicator light circuit board 165 is disposed inside the indicator light bracket 164, a top of a lamp bead 166 on the indicator light circuit board 165 penetrates through a top of the upper cover 101, a battery 167 is disposed inside the base 161, a bottom of the base 161 penetrates through the fixed base 15 and extends into the operation port 108, and a charging port sealing plug 168 and a waterproof switch button 169 are disposed on the bottom of the base 161.

The charging port sealing plug 168 and the waterproof switch button 169 meet the IPX8 standard to ensure the safety of underwater circuits. The charging port sealing plug 168 is pulled out to charge the battery 167 through a charging port. The indicator light circuit board 165 displays a charging and fault status in real time. Pressing the waterproof switch button 169 can activate the motor 163 to drive the impeller 33 to rotate for drainage. The battery 167 is electrically connected with the motor 163, the indicator light circuit board 165 and the inductor circuit board 109. The charging port sealing plug 168 and the waterproof switch button 169 are arranged on the bottom of the base 161 to facilitate user operation.

Figure 7:
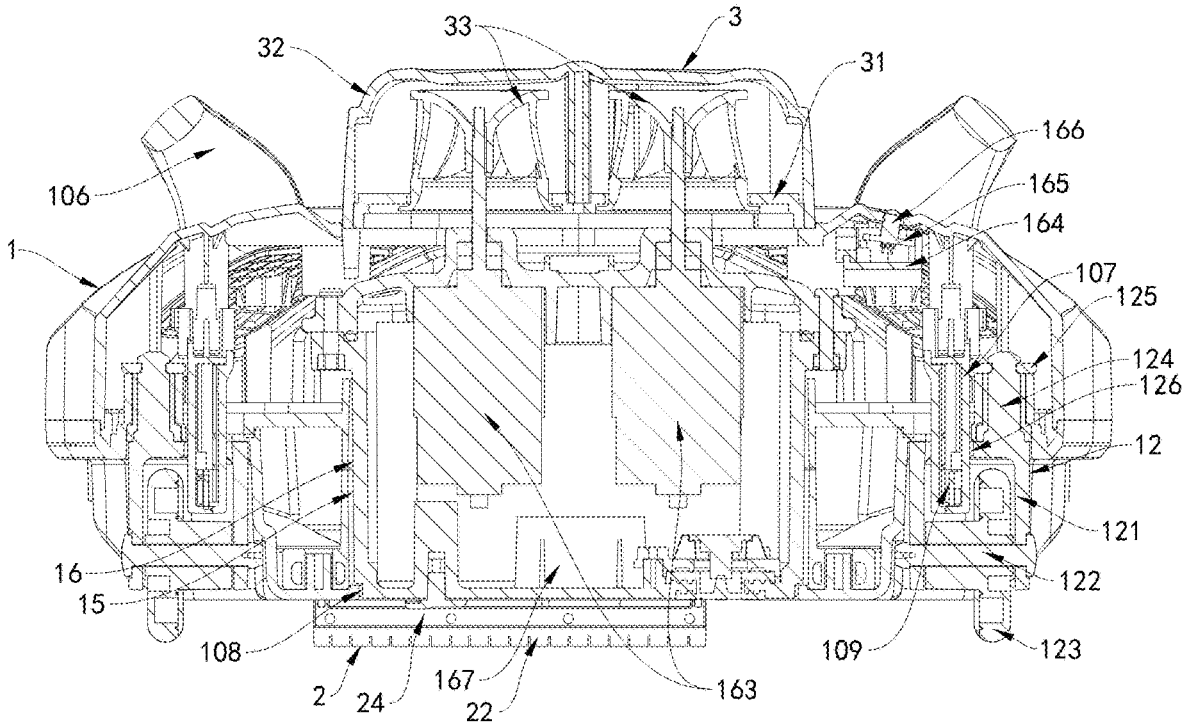
FIG. 7 is a cross-sectional view of a cleaning device body according to the present disclosure.
Figure 8:
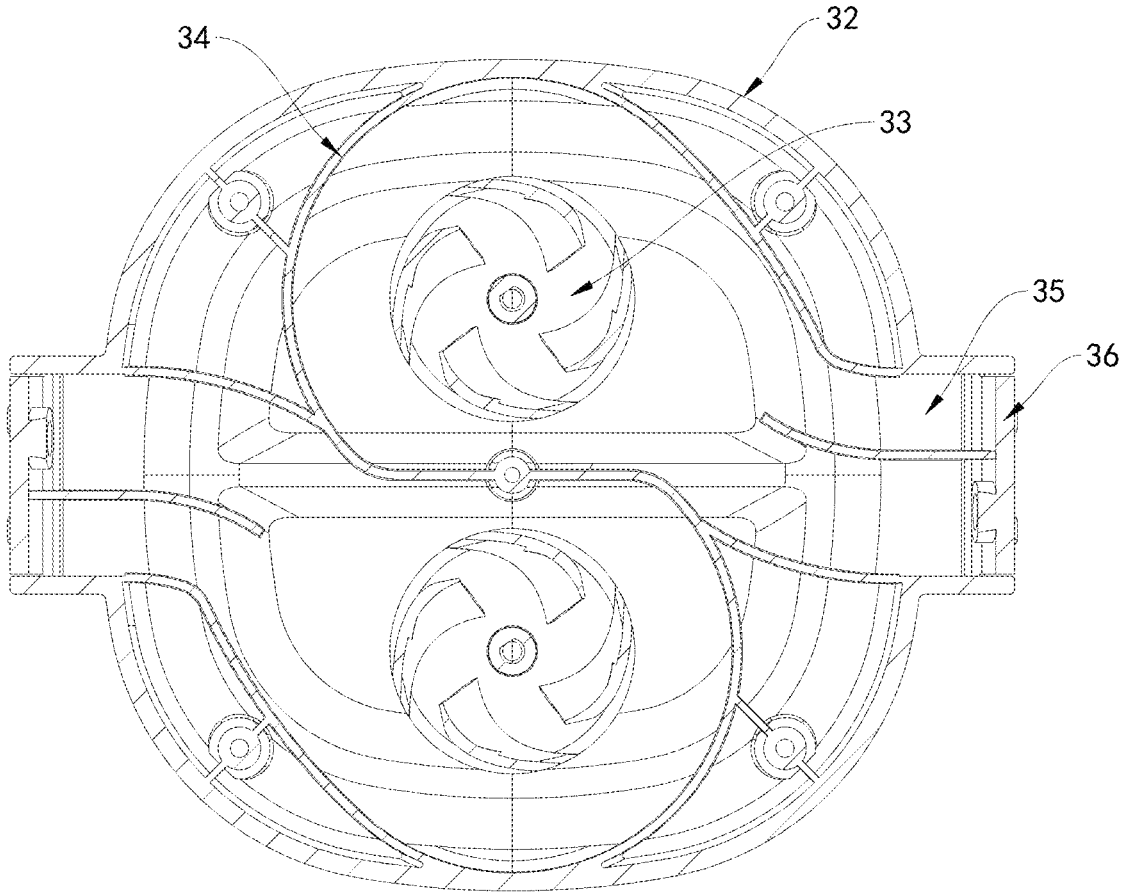
FIG. 8 is a cross-sectional view of a drainage enclosure according to the present disclosure.

As shown in FIGS. 7-8, in some embodiments, the water outlet component 3 includes a flow channel baffle 31 disposed on a top of the upper cover 101 and a drainage cover 32 disposed on a top of the flow channel baffle 31. Two impellers 33 are rotatably disposed inside the flow channel baffle 31, and interiors of the two impellers 33 are fixedly sleeved with output shafts of two motors 163, respectively. Two drainage enclosures 34 are disposed inside the drainage cover 32. Tops of the two impellers 33 extend into the drainage cover 32 and are arranged concentrically with centers of the two drainage enclosures 34, respectively. Drainage ports 35 respectively connected to the two drainage enclosures 34 are disposed on two sides of the drainage cover 32, and a water outlet flap 36 is movably disposed inside each drainage port 35.

The drainage enclosures 34 concentrical with the impellers 33 form the vortex to improve the efficiency of discharging fine impurities. The movable water outlet flap 36 automatically adjusts the opening and closing degree according to the water pressure to prevent backflow pollution. The design of the double drainage ports 35 speeds up the water circulation speed and shortens the single cleaning cycle.

In summary, the maintenance of the filter screens 11 and the impellers 33 is facilitated through the detachable structure of the upper cover 101 and the lower cover 102, and the linkage with the inductor brackets 107 and the through holes 126 is formed, and the inductor brackets 107 are automatically separated during disassembly and assembly, which simplifies assembly and ensures connection stability. The guide wheel 12 system significantly improves the travel stability and obstacle crossing ability of the device on the bottom of the pool through the precise cooperation of the wheel grooves 13 and the caster round shafts 14. The dual-motor 163 drive cooperates with the concentrical drainage enclosures 34 to form an efficient vortex, which ensures that the cleaning ability can still be maintained when a single motor 163 fails, and greatly improves the efficiency of discharging fine impurities. In terms of user-friendly design, the alignment and maintenance scheme of the operation port 108 and the fixed base 15, the swingable and detachable soft rubber scraper 22, the waterproof switch and other details cooperate with each other. Under the premise of ensuring IPX8 waterproof performance, the equipment maintenance is more convenient and the service life is longer. The overall structure achieves comprehensive improvement in cleaning efficiency, operation reliability and maintenance convenience through the organic cooperation among various components.

Finally, it should be noted that the above description is only a preferred embodiment of the present disclosure and is not intended to limit the present disclosure. Although the present disclosure has been described in detail with reference to the embodiments, those skilled in the art can still modify the technical solutions described in the embodiments or replace some of the technical features therein by equivalents. Any modification, equivalent replacement, improvement, etc. made within the spirit and principle of the present disclosure shall be included in the protection scope of the present disclosure.

The invention claimed is:

1. A swimming pool cleaning device of an underwater robot, comprising:

a cleaning device body (1);

a water inlet component (2) disposed at a bottom of the cleaning device body (1);

a water outlet component (3) disposed at a top of the cleaning device body (1);

a filter screen (11) disposed in the cleaning device body (1) and between the water inlet component (2) and the water outlet component (3); and a plurality of guide wheels (12) disposed on the bottom of the cleaning device body (1);

wherein the water inlet component (2) includes a water inlet (21) disposed on the bottom of the cleaning device body (1), a soft rubber scraper (22) disposed on one side of the water inlet (21), two water inlet fixing members (23) disposed in a lower cover (102) and on two sides of the water inlet (21), respectively, a three-hole plug (24) hinged to a bottom of the lower cover (102) and disposed on one side of the water inlet (21); and wherein the soft rubber scraper (22) is detachably mounted on the three-hole plug (24).

2. The swimming pool cleaning device of the underwater robot of claim 1, wherein the water outlet component (3) includes a flow channel baffle (31) disposed on a top of an upper cover (101), a drainage cover (32) disposed on a top of the flow channel baffle (31), two impellers (33) rotatably disposed in the flow channel baffle (31), two drainage enclosures (34) disposed in the drainage cover (32), two drainage ports (35) connected to the two drainage enclosures (34), respectively and disposed on two sides of the drainage cover (32), respectively, and a water outlet flap (36) movably disposed in each drainage port (35);

wherein interiors of the two impellers (33) are fixedly sleeved with output shafts of two motors (163), respectively; and wherein tops of the two impellers (33) extend into the drainage cover (32) and are arranged concentrically with centers of the two drainage enclosures (34), respectively.

* * * * *